United States Patent [19]

Hancock et al.

[11] 3,982,708

[45] Sept. 28, 1976

[54] APPARATUS AND METHOD FOR PROCESSING YARN

[75] Inventors: Reginald Ronald Hancock; Peter James Reuben Maw, both of Gloucester, England

[73] Assignee: Imperial Chemical Industries Limited, London, England

[22] Filed: Mar. 10, 1975

[21] Appl. No.: 556,952

Related U.S. Application Data

[63] Continuation of Ser. No. 294,081, Oct. 2, 1972, abandoned.

[30] Foreign Application Priority Data

Oct. 4, 1971 United Kingdom ..... 46043/71

[52] U.S. Cl. ..... 242/36; 57/80; 57/86; 242/128

[51] Int. Cl.[2] ..... B65H 63/00

[58] Field of Search ..... 242/36, 37, 38, 128, 242/49; 57/80, 81, 82, 83, 86

[56] References Cited

UNITED STATES PATENTS

| | | | |
|---|---|---|---|
| 1,191,712 | 7/1916 | Lush | 57/86 |
| 2,221,869 | 11/1940 | Halin | 57/86 X |
| 2,840,979 | 7/1958 | Harmon | 57/80 X |
| 3,102,378 | 9/1963 | Walker, Jr. | 57/81 |
| 3,568,425 | 3/1971 | Zegna et al. | 57/86 X |
| 3,726,072 | 4/1973 | Ford et al. | 57/83 X |
| 3,747,314 | 7/1973 | Kilduff | 57/86 X |

*Primary Examiner*—Stanley N. Gilreath
*Attorney, Agent, or Firm*—Cushman, Darby & Cushman

[57] ABSTRACT

Apparatus and method for interrupting and holding a running textile yarn unwound over-end from a yarn supply. The invention may be combined with yarn break detectors for use with synthetic yarn drawtwist machines.

5 Claims, 3 Drawing Figures

APPARATUS AND METHOD FOR PROCESSING YARN

Figure 1:
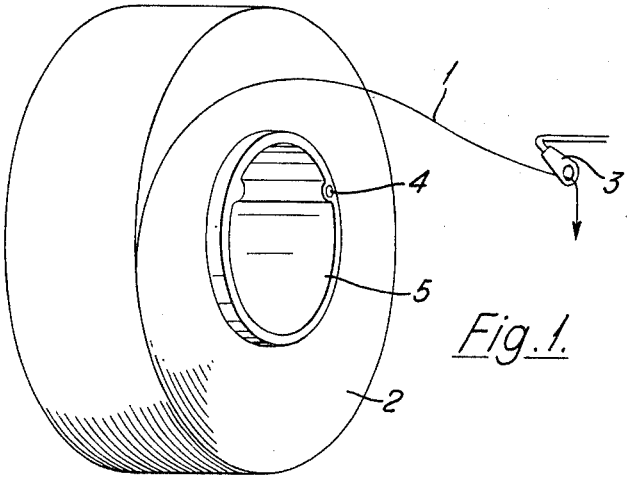

This is a continuation of application Ser. No. 294,081 filed Oct. 2, 1972, now abandoned.

The present invention relates to an apparatus and method for interrupting and holding yarn and particularly, though not exclusively, to an apparatus and method for interrupting and holding a running textile yarn when used in combination with yarn break detectors.

When filamentary yarn is unwound over-end from a yarn supply package, breakage of the yarn between the package and the yarn wind-up may result in the loose end from the supply package interfering with adjacent yarn unwinding positions, should there by any, giving rise to a progressive breakdown of those positions (known as cascade breaks), and/or being caught up by and wrapped around some moving machine part resulting in yarn wastage and possible damage to the machine. For example, in a conventional multi-position synthetic yarn drawtwist machine, in which the supply package is mounted on an overhead creel and yarn is withdrawn therefrom by the feed rolls of the drawing stage, breakage of the yarn between the supply package and the drawn yarn package may give rise to either or both of these situations. In each case the yarn continues to be withdrawn from the supply package until remedial action is taken.

In the present invention the Applicants have sought to minimise the possibility of a broken yarn end causing trouble as described above by the use of a simple yet effective yarn interrupting and holding device and method which may be brought into operation upon the detection of a broken yarn and hence a yarn end.

Thus the present invention provides an apparatus for interrupting and holding a running yarn unwound over-end from a yarn supply comprising means for introduction into the path of the yarn about which the yarn wraps itself on continued unwinding until breaking.

The present invention also provides a method for interrupting and holding a running yarn unwound over-end from a yarn supply in which means are introduced into the path of the yarn about which the yarn wraps itself on continued unwinding until breaking.

Means about which the yarn wraps itself may conveniently take the form of an elongated pin located in such a position close to the yarn supply that when introduced into the path of the running yarn, the over-end unwound yarn is drawn around the pin in a number of helical turns until gripped sufficiently tightly by the effect of such wrapping that the yarn breaks and unwinding ceases.

Preferably, the elongated pin is located, prior to introduction into the path of the yarn, within a hollow bobbin cylinder upon which the yarn supply is wound.

A number of yarn break detectors may be employed in combination with the present invention. For example, a photo-electric cell (photo-diode) suitably located in the yarn path may be used to detect the absence of the yarn and energise the yarn interrupting and holding means via a solenoid. When fitted to a drawtwist machine employing a ring and traveller yarn wind-up the photo cell is preferably mounted immediately below the lappet (balloon) guide. Alternatively, a fluidic/-pneumatic detecting unit may be used to monitor the presence of the running yarn, low pressure jets of air being separated by the presence of the yarn; in the absence of the yarn, the jets impinging upon each other resulting in a back pressure which may be amplified to actuate the yarn interrupting and holding means. When fitted to a drawtwist machine as above the unit may be mounted in the same position as the photo cell. Further, an increasing diameter arising from an unattended wrap on a rotating part, such as a feed or draw roll on a drawtwist machine, may provide the motive power to actuate pre-set spring loaded yarn interrupting and holding means; in which case wrap detecting means such as a simple pivoted arm may be linked mechanically to the interrupting and holding means.

Figure 2:
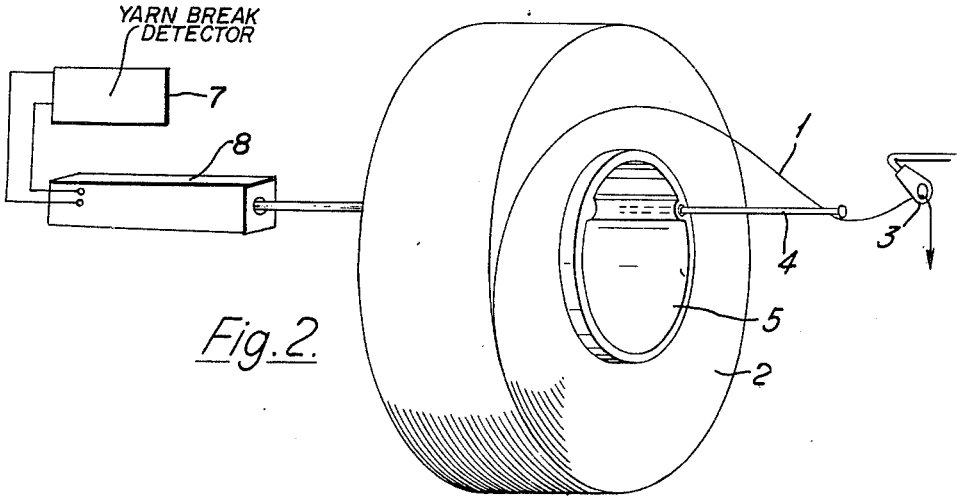
Figure 3:
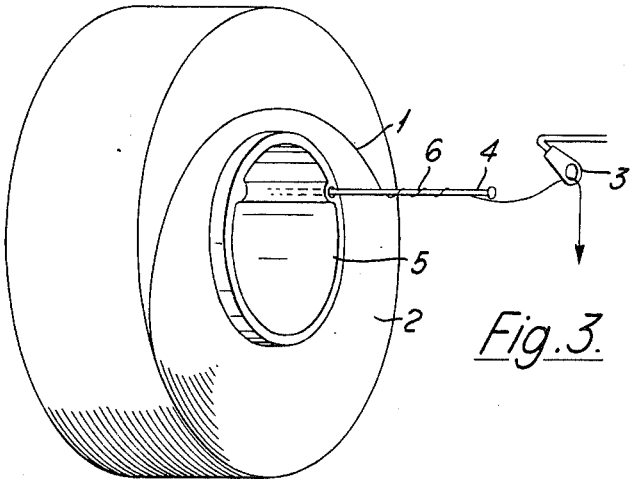

In the practise of the present invention the Applicants prefer to use a photo-electric yarn break detector. By way of illustration only of the present invention reference is made to the accompanying drawings, in which FIG. 1 depicts a yarn supply package in a typical over-end unwinding position, FIG. 2 depicts the same package but with the unwound yarn contacting an extended pin, and FIG. 3 depicts the unwound yarn wrapped around the pin prior to breaking.

Referring to FIG 1, yarn 1 is withdrawn over-end from yarn package 2 through a take-off eyelet guide 3 by, for example, the feed rolls of a drawtwist machine (not shown). In FIG 2, a yarn break having been detected by a yarn break detector 7 employing a photo-electric cell located immediately below the balloon guide and the yarn being unwound under the influence, for example, of some moving machine part, an elongated pin 4 suitably located within the package cylinder 5 is moved longitudinally by means of a solenoid 8 activated from the break detector 7, into the path of the ballooning yarn, so that upon continued unwinding the yarn winds a number of helical wraps 6 around the pin, as shown in FIG. 3. With each successive wrap of yarn around the pin, the force required to unwind the yarn increases until eventually the yarn breaks. Thus the loose yarn end remains held by the pin at the package until "re-stringing" can take place. Once the yarn has been re-strung the pin 4 can be pushed back to its original position.

Depending upon the nature of the yarn break detector used in the operation of the present invention, appropriate, yet clearly obvious modification of the manner in which the interrupting and holding means may be re-set, will need to be made.

The Applicants envisage an "unpolished" steel pin of circular cross-section for interrupting and holding the yarn, as the lower the friction between the pin and the yarn, the greater the number of wraps that will need to be wound before the yarn breaks and thus the tighter the final hold of the pin upon the yarn end.

Though reference has been made above to the use of the present invention in combination with a synthetic yarn drawtwist machine, the invention is by no means limited thereto, and is equally applicable to any yarn processing operation in which yarn is unwound over-end.

What we claim is:

1. In apparatus for interrupting a running yarn unwound overend from a wound package wherein a yarn balloon is formed by the running yarn, breaking the yarn and holding the upstream end thereof in response to an unwinding malfunction: an elongate member located within said yarn balloon and normally out of contact with said running yarn and means responsive to an unwinding malfunction for introducing said elongate member into the path of the running yarn such that the yarn wraps itslf around the member in a number of helical turns until held sufficiently tightly that the yarn breaks and unwinding ceases.

2. Apparatus as in claim 1 wherein said elongate member comprises a cylindrical pin.

3. Apparatus as in claim 2 wherein said package includes a hollow bobbin and wherein said pin is located prior to introduction into the path of the yarn within the bobbin.

4. Apparatus as in claim 1 including a yarn break detector and means responsive thereto upon breakage to actuate said introducing means.

5. A method for interrupting and holding a running yarn unwound over-end from a wound package wherein the running yarn forms a yarn balloon comprising introducing an element into the path of the yarn from a position within the yarn balloon at a location such that upon continued unwinding the yarn wraps itself in a number of helical turns around and grips the member so as to become broken.

* * * * *